United States Patent [19]

Yamada et al.

[11] Patent Number: 4,713,582

[45] Date of Patent: Dec. 15, 1987

[54] SPARK PLUG

[75] Inventors: Manabu Yamada; Ichirou Yoshida, both of Kariya; Shunzo Yamaguchi; Morihiro Atsumi, both of Okazaki, all of Japan

[73] Assignee: Nippondenso Co., Ltd., Kariya, Japan

[21] Appl. No.: 847,925

[22] Filed: Apr. 3, 1986

[30] Foreign Application Priority Data

Apr. 4, 1985 [JP] Japan ..... 60-71435

[51] Int. Cl.[4] ..... H01B 1/06; H01T 13/02

[52] U.S. Cl. ..... 315/58; 315/71; 313/118; 252/513; 252/516; 252/519

[58] Field of Search ..... 313/134, 136, 141; 252/500, 502, 503, 512, 514, 516; 315/58

[56] References Cited

U.S. PATENT DOCUMENTS

| | | | |
|---|---|---|---|
| 3,995,184 | 11/1976 | Insley | 313/136 X |
| 4,345,179 | 8/1982 | Asai et al. | 313/136 |
| 4,601,848 | 7/1986 | Sakai et al. | 252/503 |

*Primary Examiner*—David K. Moore
*Assistant Examiner*—Mark R. Powell
*Attorney, Agent, or Firm*—Cushman, Darby & Cushman

[57] ABSTRACT

A spark plug having an improved radio noise suppression effect and durability of the resistor. The resistor of the spark plug is made of a sintered material comprising by weight, 0.9–3.0% of one of TiN, TiC, WC, $TiB_2$, ZrC, HfC, SiC, TaC, $MoSi_2$ and mixtures thereof, 9–40% of fine glass powder having a larger grain size than that of said conductive material, not more than 20% of magnetic substance, and 60–90% of coarse glass powder having a larger grain size than that of the fine glass powder. The composition is free of elemental carbon.

7 Claims, 6 Drawing Figures

SPARK PLUG

BACKGROUND OF THE INVENTION

Field of the Invention

This invention relates to an improvement of spark plugs employed in a high voltage ignition circuit of an internal combustion engine and more particularly to an improvement of a resistor in the spark plug for suppressing radio noises generated from the spark plugs.

Discussion of the Related Art

High frequency noise currents generated from a spark plug can be suppressed, for example, by means of a high frequency radio wave absorbing circuit. This circuit is made by connecting a resistor in series with a terminal metal member fitted to an end of an internal passage of the spark plug and a center electrode fitted to the other end of the internal passage.

Conventionally, a mixture of carbon, zirconia, (or alumina or magnesia) and glass baked to the internal passage of a spark plug has been known for the resistor. This resistor comprises high resistive glass and carbon (electrically conductive material) forming a current path in a zigzag shape in order to improve a noise current suppression effect. (This noise current suppression effect by means of the zigzag shape of the current path is hereinafter referred to as "a structure effect".)

The radio noise suppression effect of the conventional resistor composed of carbon, zirconia and glass, however, is not sufficient. Japanese unpublished patent application No. 224,380/1984, filed on Oct. 25, 1984 and having the same assignee as that of the present invention, proposed a spark plug having a resistor made of glass powders comprising two groups of different grain sizes, carbon and a magnetic substance.

The abovementioned spark plug is superior in a radio noise suppression effect, but it has been learned that the durability of the resistor is shortened due to reaction with carbon and the magnetic substance. It also has been learned that the reaction makes gaps around the magnetic substance and deteriorates the radio noise suppression property.

SUMMARY OF THE INVENTION

An object of the present invention is to provide a spark plug having a superior radio noise suppression effect by improving the resistor.

Another object of the present invention is to provide a spark plug having an enhanced durability of the resistor.

As a substitute for carbon used in the abovementioned spark plug, the present invention is to use one electrically conductive material selected from the group consisting of titanium nitride (TiN), titanium carbide (TiC), tungsten carbide (WC), titanium boride ($TiB_2$), zirconium carbide (ZrC), hafnium carbide (HfC), silicon carbide (SiC), tantalum carbide (TaC), molybdenum silicide ($MoSi_2$) and mixtures thereof.

BRIEF DESCRIPTION OF THE DRAWINGS

The exact nature of this invention, as well as other objects and advantages thereof, will be apparent from the consideration of the following specification relating to the accompanying drawings in which.

DETAILED DESCRIPTION OF THE INVENTION

Figure 1:
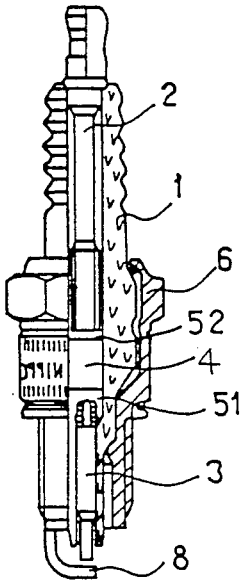
FIG. 1 shows a sectional view of a spark plug of the present invention.

As shown in FIG. 1, the spark plug of the present invention comprises an insulator 1 having an internal passage extended in the axial direction of the spark plug, a terminal meter member 2 fitted to an open end of the internal passage of the insulator 1, a center electrode 3 fitted to the other open end of the internal passage of the insulator 1, and a resistor 4 positioned between the terminal metal member 2 and the center electrode 3 on the inside of the internal passage of the insulator 1, wherein the resistor 4 is made of a sintered material comprising, by weight, 0.9–3.0% of one electrically conductive material selected from the group consisting of titanium nitride (TiN), titanium carbide (TiC), tungsten carbide (WC), titanium boride ($TiB_2$), zirconium carbide (ZrC), hafnium carbide (HfC), silicon carbide (SiC), tantalum carbide (TaC), molybdenum silicide ($MoSi_2$) and mixtures thereof, 9–40% of fine glass powder having a larger grain size than that of the conductive material, not more than 20% of magnetic substance, and 60–90% of coarse glass powder having a larger grain size than that of the fine glass powder.

Except for the resistor 4, conventional structural members may be used for such parts of the spark plug of this invention as the insulator 1, the terminal metal member 2, the center electrode 3 and the like.

Figure 2:
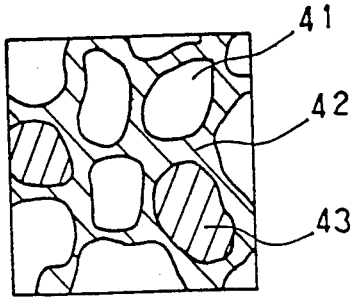
FIG. 2 is a structural view showing the microscopic structure of the resistor employed in the spark plug of the present invention.

As shown in FIG. 2, the resistor 4 comprises high resistive coarse glass powder 41, a magnetic substance 43 and a current path 42 formed in a zigzag shape around the coarse glass powder 41 and the magnetic substance 43. The current path 42 is mainly made of glass powder, and the abovementioned conductive material such as titanium nitride is dispersed around the fine glass powder.

The grain size of the coarse glass powder 41 is larger than that of the fine glass powder and preferably about from 50 to 300 microns. If the grain size of the coarse glass powder 41 is less than 50 microns, the coarse glass powder 41 tends to soften in a normal use, whereby the current path 42 becomes unstable. If the grain size of the coarse glass powder 41 exceeds 300 microns, gaps tend to occur between the coarse glass powder 41 and the current path 42 in welding the resistor 4 inside the insulator 1.

The ratio of the coarse glass powder 41 to the entire resistor 4 is set to 60–90 wt %. When this ratio is less than 60 wt %, the abovementioned structural effect cannot be sufficiently obtained. On the other hand, when this ratio exceeds 90 wt %, the abovementioned gaps are increased and the durability of the resistor is worsened.

The magnetic substance 43 absorbs high frequency noise currents. Namely, the magnetic substance 43 reduces high frequency noise currents by converting energy of the noise currents to magnetization energy of the spin of the magnetic substance 43 and/or to a joule heat. Therefore, the relative permeability of the magnetic substance 43 is required to be more than 10.

The following may be used for the magnetic substance 43.

(a). Ferrite of reverse spinel structure composed of $M^{II}O.Fe_2O_3$
(beryllium (Be), manganese (Mn), iron (Fe), cobalt (Co), nickel (Ni), copper (Cu), zinc (Zn), magnesium (Mg), cadmium (Cd), lithium (Li) or a compound material thereof is employed for the bivalent metal $M^{II}$.)

(b). Hexagonal crystal ferrite such as BaO6FeO, $PbO.6Fe_2O_3$ and $SrO.6Fe_2O_3$ (c). a compound of (a) and (b)

(d). garnet ferrite ($3R_2O_3.5Fe_2O_3$)
(yttrium (Y), samarium (Sm), europium (Eu), cadmium (Cd), terbium (Tb), dysprosium (Dy), holmium (Ho), erbium (Er), thulium (Tm), ytterbium (Yb), and
lutetium (Lu) are employed for R.)

The ratio of the magnetic substance to the entire resistor should be 20 wt % or less. When this ratio is more than 20 wt %, the durability of resistor is worsened. The grain size of the magnetic substance should range from 10 to 300 microns. When the grain size of the magnetic substance is less than 10 microns, the magnetic substance melts into the glass by its reaction with the coarse glass powder in a heating process and thereby causes its magnetic property to be lost, its absorption of high frequency noise currents to decrease and its magnetic domain to be lost. If the grain size of the magnetic substance is larger than 300 microns, gaps tend to occur between the magnetic substance and the coarse glass powder because the glass softens at a high temperature while the magnetic substance does not, and thus the stability and durability of the resistor 4 decrease. In addition, the specific resistance of the magnetic substance should exceed $10^2$ ohm.cm. When the specific resistance is less than $10^2$ ohm.cm, the magnetic substance becomes electrically conductive and thus the current path of the resistor 4 becomes too wide to obtain the aforesaid structural effect.

The grain size of the fine glass powder which constitutes the main component of the current path 42 should be less than that of the coarse glass powder and more than the conductive material such as titanium nitride, i.e., preferably be about 5–80 microns. When the grain size of the fine glass powder is more than 80 microns, gaps tend to occur in the current path 42. When the grain size of the fine glass powder is less than 5 microns, the current path becomes unstable because the fine glass powder melts with the conductive material such as titanium nitride. Preferably, the ratio of the fine glass powder to the entire resistor is from 9 to 40 wt %. This range is determined because when this ratio is less than 9 wt %, the durability of the resistor is worsened and when more than 40 wt %, the radio noise suppression property of the resistor deteriorates.

It is preferable that the grain size of the conductive material be smaller than that of the abovementioned fine glass powder and be about from 0.5 to 3 microns. The ratio of the conductive material to the entire resistor is preferably from 0.9 to 3.0 wt %. Outside this range, the resistance value of the spark plug cannot comply with the Japanese Industrial Standards (JIS) which requires a range of from 3.3 to 7.5 kohm for a spark plug having a resistor, and deteriorates the radio noise suppression effect.

In addition, the softening temperatures of both the fine and coarse glass powders are preferably about 300°–600° C. The softening temperature of the glass is preferably more than about 300° C. because the spark plug is heated to about 250° C. in its use. And the temperature is preferably lower than 600° C. in order to weld the resistor 4 inside the insulator 1 without oxidizing the terminal metal member 2 and the center electrode 3. Borosilicate lithium calcium glass, borosilicate glass, borosilicate lead glass, boric acid barium glass and other suitable glass can be employed for the coarse and fine glasses of the present invention.

The electric field intensity of the radio noise current from the spark plug is in proportion to the spark discharge current. The radio noise current from the spark plug is suppressed by the resistor 4 provided in an ignition circuit. The radio noise suppression effect is enhanced by the structural effect of the coarse glass powder 41 in the resistor 4. Meanwhile the fine glass powder, as a main component of the current path 42, which substitutes known zirconia causes less gaps in the current path 42. Thereby, the current path 42 is stable in the present invention. In addition, by substituting for carbon such an electrically conductive material as titanium nitride, the gaps around the magnetic substance 43 are decreased and the reaction of carbon with the magnetic substance is eliminated. Accordingly, the spark plug of the present invention is enhanced in the radio noise suppression effect and the durability of the resistor.

TABLE 1

| | CHEMICAL COMPOSITION (wt %) | | | | | |
|---|---|---|---|---|---|---|
| | CONDUCTIVE MATERIAL | | | FINE GLASS | COARSE GLASS | |
| | TiN | TiC | Carbon | POWDER | POWDER | FERRITE |
| EMBODIMENT A (TiN) | 2.0 | | | 21.0 | 72.5 | 4.5 |
| EMBODIMENT B (TiC) | | 2.0 | | 21.0 | 72.5 | 4.5 |
| COMPARATIVE MODEL C (Carbon) | | | 0.4 | 22.6 | 72.5 | 4.5 |

TABLE 2

| NO. | ferrite | $Fe_2O_3$ | NiO | $MnO_2$ | ZnO | $BaCo_3$ | $SrCo_3$ | $Y_2O_3$ | SINTERING AGENT |
|---|---|---|---|---|---|---|---|---|---|
| | | (wt %) | | | | | | | |
| 1 | $NiFe_2O_4$ | 50 | 50 | — | — | — | — | — | Co 0.1 |
| 2 | Ni—$ZnFe_2O_4$ | 50 | 39 | — | 11 | — | — | — | Co 0.1 |
| 3 | Mn—$ZnFe_2O_4$ | 50 | — | 25 | 25 | — | — | — | Co 0.1 |
| 4 | $BaFe_{12}O_9$ | 85.7 | — | — | — | 14.3 | — | — | Co 0.1<br>$SiO_2$ 0.1 |
| 5 | $SrFe_{12}O_9$ | 85.7 | — | — | — | — | 14.3 | — | Co 0.1<br>$SiO_2$ 0.1 |
| 6 | $Y_3Fe_5O_{12}$ | 62.5 | — | — | — | — | — | 37.5 | — |

DETAILED DESCRIPTION OF THE PREFERRED EMBODIMENTS

The present invention is explained hereunder in detail with a description of the preferred embodiments thereof.

Embodiments A and B of the spark plugs of this invention and comparative model C were manufactured as follows. All of the spark plugs were shaped as illustrated in FIG. 1.

(1) Resistor Materials

Sample resistor materials A, B and C for spark plugs A, B and C were prepared with the compositions shown in TABLE 1. In the case of preparing Sample A, for example, a mixture of titanium nitride (TiN) and lithium calcium borosilicate glass (fine glass powder) were passed through a 200-mesh sieve and the passed material was dry-grounded by means of a vibration mill. The current path material thus prepared, lithium calcium borosilicate glass (coarse glass powder) which passed through a 40-mesh sieve and ferrite (magnetic substance) which passed through a 32-mesh sieve were mixed together with a dextrin aqueous solution and a carboxymethylcellulose (CMC) aqueous solution. Then, the mixture was dried and passed through a 24-mesh sieve to obtain Sample A. Ferrite was prepared by sintering each of 6 sorts of ferrites shown in Table 2 around 1,400° C. and then grounding. Samples B and C were also manufactured in the same procedure.

(2) Baking of the Resistor

Each of samples A, B and C prepared in the above step (1) was respectively filled and baked in an internal passage of an insulator 1 shown in FIG. 1, to obtain spark plugs A, B and C.

An center electrode 3 was inserted in the lower end of the internal passage of the insulator 1 and than 0.26 g of copper glass which was a mixture of glass composed, by weight, of 64% $SiO_2$, 6% $Al_2O_3$, 23% $B_2O_3$ and 7% $Na_2O$ and copper powder at the ratio of 1:1 was filled on the center electrode 3. Then a pressure of 250 kg was applied by the use of a terminal metal with $\phi$ 4.75. After that, 0.5 g of the abovementioned resistor material was added on the copper glass and a pressure was applied thereon in two successive process. Then 0.46 g of the copper glass was placed on the resistor material, and a pressure of 200 kg was applied on the copper glass by means of the terminal metal. Then the spark plug was placed in a furnace for thirty minutes at a temperature of 870° C. to soften the copper glass and the fine and coarse glass powders in the resistor material. Then, after the spark plug was taken out of the furnace and a pressure of 60 kg was immediately applied onto the terminal metal. Thus, the resistor material (each of Samples A, B and C) became the resistor 4 and the two pieces of copper glass respectively became the copper glass electrodes 51 and 52. In addition, the resistive value of the resistor 4 was controlled to comply with Japanese Industrial Standards (JIS).

After the insulator 1 was cooled, a housing 6 having an earth electrode 8 was placed around the insulator 1 to obtain spark plugs A, B and C, shown in FIG. 1.

(3) Evaluation

Figure 3:
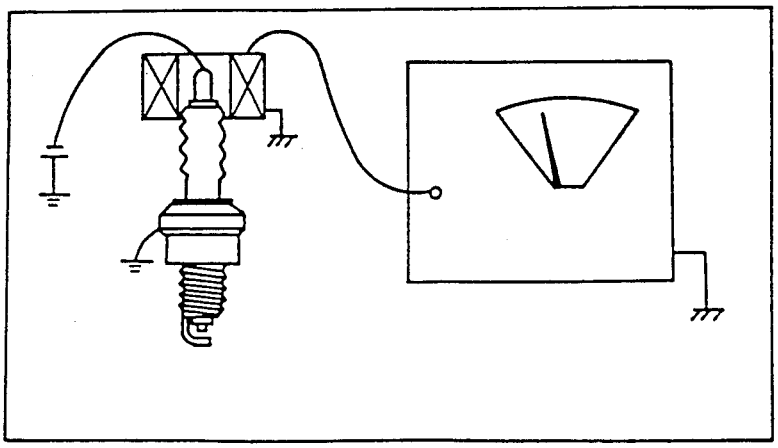
FIG. 3 is a schematic illustration showing an apparatus for measuring noise field intensity.
Figure 4:
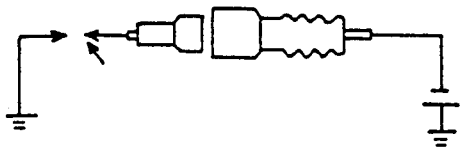
FIG. 4 is a schematic illustration showing an equipment for measuring durability of a resistor.
Figure 5:
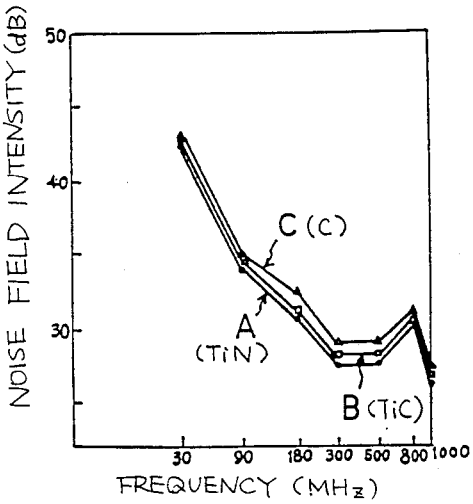
FIG. 5 is a graph showing the measurement of the frequency characteristics of intensity of noise field radiated from the spark plugs A and B, according to the embodiments of the present invention in comparison with the conventional spark plug C.

The radio noise field intensity was measured with each of the spark plugs A, B and C to evaluate its noise suppressing effect. The results are shown in FIG. 5. To measure the noise field intensity of the spark plugs, each spark plug was placed under 4 barometric pressure approximately equivalent to the pressure in an engine of an automobile. Then a discharge aging was done for several minutes at revolution of 2,000 rpm. Thereupon, noise field intensity was measured at various frequencies by means of an apparatus for measuring noise field intensity shown in FIG. 3. The measured values shown in FIG. 5 were maximum values measured at each frequency.

As shown in FIG. 5, the noise field intensity of spark plugs A and B as the embodiments of this invention are distinctly lower than that of the comparative model C at every frequency. This is because titanium nitride and fine glass powder are used as materials of the current path 42 in the present invention.

Figure 6:
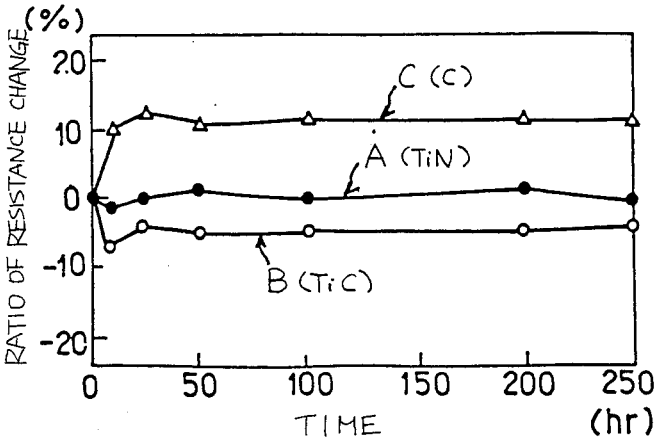
FIG. 6 is a graph showing the ratio of the resistance change of the spark plugs A and B of the embodiments of the present invention and the conventional spark plug C.

Also, the durability test for the resistor was conducted by using a three wire method with 10 mm interval and measuring the ratio of the resistance change. The results are shown in FIG. 6. As apparent from this figure, the embodiments A and B of the present invention are superior to the conventional comparative model C.

The resistor having carbon as a conductive material was observed to have gaps around the ferrite after its long use. An X-ray diffraction of this ferrite showed its peak when $2\theta=39.53$, 42.89 and 44.29. These peaks were not those of ferrite but those of iron carbide ($Fe_3C$) which should be resulted from the reaction of ferrite and carbon. Therefore, ferrite as an electrically conductive material was replaced with titanium nitride or titanium carbide. Then the peaks of iron carbide were disappeared and the gaps around ferrite were decreased. The radio noise suppresion effect and the durability of the resistor were improved.

In addition to titanium nitride (TiN) and titanium carbide (TiC), tungsten carbide (WC), titanium boride ($TiB_2$), zirconium carbide (ZrC), hafnium carbide (HfC), silicon carbide (SiC), tantalum carbide (TaC), molybdenum silicide ($MoSi_2$) and mixtures thereof are also employed as a conductive material.

What is claimed is:

1. A spark plug comprising:

an insulator having an internal passage extended in the axial direction of said spark plug and having two open ends;

a terminal metal member fitted to one said open end of said internal passage of said insulator;

a center electrode fitted to the other said open end of said internal passage of said insulator;

a resistor positioned between said terminal metal member and said center electrode inside of said internal passage of said insulator, said resistor being substantially free of elemental carbon and being made of a sintered material comprising by weight:

from 0.9 to 3.0% of one conductive material selected from the group consisting of titanium nitride (TiN), titanium carbide (TiC), tungsten carbide (WC), titanium boride ($TiB_2$), zirconium carbide (ZrC), hafnium carbide (HfC), silicon carbide (SiC), tantalum carbide (TaC), molybdenum silicide ($MoSi_2$) and mixtures thereof;

from 9 to 40% of fine glass powder having a larger grain size than that of said conductive material;

not more than 20% of ferrite; and from 60 to 90% of coarse glass powder having a larger grain size than that of said fine glass powder.

2. A spark plug according to claim 1, wherein the grain size of said conductive material is from 0.5 to 3 microns.

3. A spark plug according to claim 1, wherein said conductive material is one selected from titanium nitride and titanium carbide.

4. A spark plug according to claim 3, wherein said fine glass powder is one selected from the group consisting of borosilicate lithium calcium glass, borosilicate glass, borosilicate lead glass and boric acid barium glass.

5. A spark plug according to claim 3, wherein said coarse glass powder is one selected from the group consisting of borosilicate lithium calcium glass, borosilicate glass, borosilicate lead glass and boric acid barium glass.

6. A spark plug according to claim 1, wherein said ferrite is of a reverse spinel structure composed of $M^{II}O.Fe_2O_3$.

7. A spark plug according to claim 1, wherein the grain size of said fine glass powder ranges from 5 to 80 microns and the grain size of said coarse glass powder ranges from 50 to 300 microns.

* * * * *